United States Patent [19]

Duvdevani et al.

[11] Patent Number: 4,516,982

[45] Date of Patent: May 14, 1985

[54] ANTIMISTING SYSTEM FOR HYDROCARBON FLUIDS

[75] Inventors: Ilan Duvdevani, Leonia; Dennis G. Peiffer, East Brunswick; John A. Eckert, Mountainside; Robert D. Lundberg, Bridgewater, all of N.J.

[73] Assignee: Exxon Research and Engineering Co., Florham Park, N.J.

[21] Appl. No.: 547,905

[22] Filed: Nov. 2, 1983

[51] Int. Cl.[3] ..... C10L 1/24

[52] U.S. Cl. ..... 44/62; 44/71

[58] Field of Search ..... 44/62, 71; 525/217, 525/203; 524/516, 521, 501, 504

[56] References Cited

U.S. PATENT DOCUMENTS

| | | | |
|---|---|---|---|
| 3,475,358 | 10/1969 | Bixler | 524/521 |
| 3,546,142 | 12/1970 | Michaels | 524/521 |
| 3,867,330 | 2/1975 | Frisque | 524/516 |
| 4,118,439 | 10/1978 | Marze | 525/203 |

*Primary Examiner*—Y. Harris-Smith

*Attorney, Agent, or Firm*—Richard E. Nanfeldt

[57] ABSTRACT

The present invention relates to hydrocarbon, and specifically jet fuels, solutions having dilatant properties in which the hydrocarbon solution contains a polymer complex which is the interaction product of a sulfonate containing polymer and an amine containing copolymer.

10 Claims, No Drawings

ANTIMISTING SYSTEM FOR HYDROCARBON FLUIDS

FIELD OF THE INVENTION

The present invention relates to hydrocarbon, preferably jet fuel solutions having dilatant properties in which the hydrocarbon solution contains a polymer complex incorporating polymer backbones containing anionic and amine moieties.

BACKGROUND OF THE INVENTION

In recent years, interpolymer complexes have received considerable attention in the literature due to their interesting and unique properties. In most instances, these complexes are formed by initimately mixing aqueous solutions containing high-charge density polyelectrolytes possessing opposite charge. When these polymer molecules meet in solution, the interaction between oppositely charged sites will cause the release of their associated counterions forming the complex. The counterions are now free to diffuse into the bulk solution. Normally, phase separation occurs upon prolonged standing in these high-charged density complexes. As a result, these materials have poor rheological properties.

Polymeric materials are useful as viscosity enhancers when dissolved in the appropriate solvent system. The principle reason for this behavior is due primarily to the large volume which a single macromolecular chain can occupy within the solvent. An increase in the size of the chain produces a concomittant enhancement in the solution viscosity. However, when the polymer chain is placed in a shear field, segmental orientation takes place in the direction of the shearing force. The viscosity of the fluid dramatically drops due to this orientation phenomena. This is a typical behavior of most solutions containing dissolved polymeric materials. However, if the polymer molecule has a high molecular weight with a relatively flexible backbone and the solvent viscosity is sufficiently high, different behavior can be anticipated. It has been shown by several groups that, with increasing shear rates, the viscosity should show a decrease, followed by a minimum value and a small subsequent increase in cases where both solvent viscosity and polymer molecular weight are very high. This latter effect gives rise to a slight dilatant behavior. However, the above-mentioned conditions required for the appearance of a slight shear thickening behavior in these polymeric solution systems are not applicable for many technologically interesting fluids. In most of the common synthetic polymers, it is difficult from a synthetic viewpoint to obtain sufficiently high molecular weight and, in addition, most solvents (for example, jet fuels) have rather low viscosities.

This invention discloses the novel and unexpected result that interpolymer complexes are capable of enhancing the viscosity of hydrocarbon solutions under relatively broad shear conditions. With these unique polymeric materials, dilatant behavior occurs in hydrocarbon fluids which are of broad technological utility and useful in antimisting applications, preferably for jet fuel. It is further observed that under the identical experimental conditions, the viscosity of the individual copolymer components show the normal shear thinning behavior.

Polymers with very high molecular weight can be used to modify a solvent for antimisting behavior. In this invention it is disclosed that an alternative to ultra high molecular weight additives are lower molecular weight polymers which are capable of associating in solution, thereby building a network of a very high molecular weight. A way for achieving such networks is the complexation of two dissolved polymers, one having anionic charges along its backbone and the other having cationic charges along its backbone. The complex can be achieved by dissolving each polymer alone in the solvent and combining the two solutions. Alternately, each polymer can be codissolved in the same solution system. When polymer molecules of opposite charges meet in solution, an interaction occurs between oppositely charged sites forming a complex which involves the associated counterions that may have been present in one or both polymers.

In order to avoid phase separation of the complex in solution, the charge density along the polymer backbones should be relatively low. The resulting solution of such a complex is then significantly more viscous than solutions containing the individual polymers, provided that the total numbers of negative and positive charges are correctly balanced. Upon addition of a strongly polar agent such as an alcohol the complex can be disturbed and the viscosity reduced.

It was found that for a given balance of the various parameters that may be varied in an interpolymer complex solution, an unexpected shear thickening (dilatant) behavior may be obtained. These parameters include:

- Backbone nature of each of the polymers (or copolymers).
- The charge densities along the polymer backbones.
- The molecular weight of each polymer.
- The ratio between the polymers introduced into solution.
- The solvent (and cosolvent, if any).
- The concentration of polymer in solution.

As explained above, most solutions of high molecular weight polymers are expected to exhibit a shear thinning behavior. Interpolymer complexes under narrow conditions seem on the other hand to possess an ability to establish even larger networks or act as if networks are larger under high shear rates resulting in shear thickening.

Shear thickening behavior can be useful in affecting antimisting characteristics. Such a solution can behave as a fairly low viscosity fluid at low shear rates. However, the viscosity begins to rise as the shear rate is progressively increased. Accordingly, the solution can more effectively resist breakup into a mist of minute droplets. This is a very desirable attribute in a variety of fluids of technological interest and specifically jet fuels. Another desirable attribute is to be able to reverse (or erase) the abovementioned antimisting behavior and render it atomizable. With regard to interpolymer complexes, this is readily achieved through addition of a soluble component capable of weakening or totally distrupting the ionic linkages which hold the complex together. Such a component should be highly polar, soluble in the solution containing the dissolved interpolymer complex and capable of efficiently migrating (and disrupting) to the ionic linkages. Alcohols and amines are only two of many possible examples.

Finally, the novel polymeric systems described here are readily soluble in aliphatic as well as aromatic hydrocarbons making them useful as additives to jet fuels and other distillates of crude oil.

SUMMARY OF THE INVENTION

The present invention relates to hydrocarbon, specifically jet fuel, solutions having dilatant properties in which the hydrocarbon solution contains a polymer complex incorporating polymer backbones containing anionic and amine moieties.

GENERAL DESCRIPTION OF THE INVENTION

The hydrocarbon solution of the instant invention, which exhibits dilatant and antimisting properties, is formed by the interaction of a mixture of two different polymers in the solution. There are a number of polymers which are suitable for forming the complexes.

A preferred system comprises a mixture in the hydrocarbon solution of a sulfonated polymer and an amine containing copolymer both of which are capable of dissolution in aliphatic and in aromatic solvents, or mixtures thereof.

The polymer complex is characterized as having polymer backbones which are substantially soluble in the organic liquid, and pendant sulfonate groups which are substantially insoluble in the organic liquid.

The number of sulfonate groups contained in the sulfonated polymer of the polymer complex is a critical parameter affecting this invention. The number of sulfonate groups present in the polymer can be described in a variety of ways such as weight percent, mole percent, number per polymer chain, etc. For most polymer systems of interest in this invention, it is desirable to employ mole percent. For vinyl homopolymers, such as polystyrene, the sulfonated analog having a sulfonate content of 1.0 mole percent means that one out of every 100 monomer repeat units in the polymer chain is sulfonated. In the case of copolymers, the same definition applied, except for the purposes of this calculation, the polymer can be considered to be prepared from a hypothetical monomer having an average molecular weight, which is the average of the two monomer components. Similarly for terpolymers, the same averaging concepts apply; however, three components are involved. For example, ethylene-propylene-ethylidene norbornene (ENB) is a preferred polymer backbone for this invention. A representative terpolymer would have a composition (weight percent) or 50% ethylene, 45% propylene and 5% ENB. This composition has an average repeat unit molecular weight of about 38.9. Thus, sulfonation of this composition, which occurs at the unsaturation of the ENB units to a level of 1.0 mole %, which means that in 38.9 gms (1 mole of average monomer repeat units) of this polymer, there would be present 0.01 mole of sulfonic acid groups. An alternate way of expressing this is to state the sulfonate level in terms of milliequivalents (meq.) of sulfonic acid groups per 100 gms of polymer. This latter procedure provides a rapid and independent measure of sulfonic acid content in a polymer through simple titration.

Both mole percent sulfonate and milliequivalent of sulfonate will be employed to describe the sulfonate polymers employed in this invention.

In general, the sulfonated polymer will comprise from about 4 meq. up to 200 meq. per 100 g. of polymer, sulfonate groups, more preferably about 10 meq. to about 100 meq. per 100 g. pendant sulfonate groups. The sulfonated polymers in the instant invention are neutralized with the basic materials selected from the group consisting of Groups IA, IIA, IB and IIB of the Periodic Table of the Elements and lead, tin and antimony. A preferred counter ion for this invention is zinc, as explained below. Sulfonated polymers which are subject to the process of the instant invention are illimitable and include both plastic and elastomeric polymers. Specific polymers include sulfonated polystyrene, sulfonated t-butyl styrene, sulfonated polyethylene, sulfonated polypropylene, sulfonated styrene/acrylonitrile copolymers, sulfonated styrene/methyl methacrylate copolymers, sulfonated block copolymers of styrene-/ethylene oxide, acrylic acid copolymers with styrene, sulfonated polyisobutylene, sulfonated ethylenepropylene terpolymers, sulfonated polyisoprene, and sulfonated elastomers and their copolymers such as isoprene-styrene sulfonate copolymer formed by a free radical copolymerization process.

Neutralization of the cited sulfonated polymers with appropriate metal hydroxides, metal acetates, metal oxides, etc. can be conducted by means well-known in the art. For example, the sulfonation process as with Butyl rubber containing a small 0.3 to 1.0 mole% unsaturation, can be conducted in a suitable solvent such as toluene with acetyl sulfate as the sulfonating agent. The resulting sulfonic acid derivative can then be neutralized with a number of different neutralization agents such as sodium phenolate and similar metal salts. The amounts of such neutralization agents employed will normally be stoichiometrically equal or in some excess to the amount of free acid in the polymer plus any unreacted reagent which still is present. It is preferred that the amount of neutralizing agent be equal to the molar amount of sulfonating agent originally employed plus 10% more to ensure full neutralization. The use of more of such neutralization agent is not critical. Sufficient neutralization agent is necessary to affect at least 50% neutralization of the sulfonic acid groups present in the polymer, preferably at least 90%, and most preferably essentially complete neutralization of such acid groups should be affected.

The degree of neutralization of said ionomeric groups may vary from 50 to 500 mole %, preferably 90 to 200%. It is preferred that the degree of neutralization be substantially complete, that is, with no substantial free acid present and without substantial excess of the base other than that needed to ensure neutralization. Thus, it is clear that the polymers which are utilized in the instant invention comprise substantially neutralized pendant groups and, in fact, an excess of the neutralizing material may be utilized without defeating the objects of the instant invention.

We have surprisingly found that a very important factor in determining the strength of the interaction between the amine-containing polymer and the sulfonate-containing polymer is the nature of the counterion. There are, broadly speaking, three major classes of such counterions. The first class, which are less preferred, are those metals of Group I and Group IIA, which include Li, Na, K, etc., Be, Mg, Ca, etc. We have found that these species do not interact as strongly with amine groups as the more preferred species described below. Those metals are commonly defined as members of the transition elements (see chemical text: "Chemical Principles and Properties", by M. J. Sienko and R. A. Plane, McGraw Hill Book Co., 1974, page 19). These metal cations are best exemplified by zinc and interact strongly with pyridine and similar amines. As a consequence, a zinc neutralized sulfonated polymer interacts much more strongly with a styrene/vinyl pyridine copolymer than does a magnesium or sodium neutralized system. It is for this reason that the transition elements are preferred with zinc, copper, iron, nickel and cobalt being especially preferred. We also include antimony and lead as suitable cations.

A third species which is preferred is the free acid of the sulfonated polymer, which will also interact with amine-containing polymers. In this latter case, it is clear that the interaction is a classic acid-base interaction, while with the transition metals, a true coordination complex is created, which is due to the donation of the electron pair of the nitrogen element. This distinction is a very important one and sets these complexes apart from classic acid-base interactions. The surprising observation is that such coordination complexes can form in such extreme dilution insofar as interacting groups are concerned, and that they are apparently formed so far removed from their expected stoichiometry, (based on small molecule analogs).

The amine-containing polymer is typically a polymeric backbone where the nitrogen elements are in the chain or pendant to it. Such a polymer may be obtained by direct copolymerization of a monomer containing the basic moiety with other monomers, or by grafting a monomer containing the basic moiety on to a polymerized chain. Monomers can be chosen from vinyl monomers leading to hydrocarbon soluble polymers such as styrene, t-butyl styrene, acrylonitrile, isoprene, butadiene, acrylates, methacrylates and vinyl acetate. Monomers containing a basic moiety will be those who contain amine or alkyl amine groups or pyridine groups, such as vinyl pyridine.

A preferred basic polymer for this invention is a polymer which is soluble in aliphatic and aromatic solvents such as jet fuels or other crude oil distillates. A specific preferred polymer is t-butyl styrene co-vinyl pyridine.

A variety of polymer backbones will display the desirable properties discovered in this invention:

| Sulfonate Polymer | Amine Polymer |
|---|---|
| Sulfo-EPDM | Styrene/Vinyl Pyridine Copolymer |
| Sulfonate Isoprene Copolymers | Vinyl Pyridine/Styrene/ Butadiene Terpolymers |
| Sulfonate SBR Polymers | Isoprene/Vinyl Pyridine Copolymer |
| Sulfonate Butadiene Polymers | Ethylacrylate/Vinyl Pyridine Copolymer and Alkyl Acrylate Copolymers with Vinyl Pyridine, where the Alkyl group varies in carbon number from 1 to 18 |
| Sulfonated Butyl | Methyl Methacrylate/ Vinyl Pyridine Copolymer and Alkyl Methacrylate copolymers with Vinyl Pyridine, wherein the number of carbon group in the alkyl group varies from 1 to 18 carbon atoms |
| Sulfonated Acrylate and Methacrylate Copolymers | Butadiene/Vinyl Pyridine Copolymer |
| Sulfonated Block Polymers | Propylene/Vinyl Pyridine Block Copolymer |
| | Ethylene/Vinyl Pyridine Block Copolymer |
| | t-Butyl Styrene/Vinyl Pyridine Copolymers |
| | Vinyl Pyridine Copolymers with alpha-beta ethylenically unsaturated copolymers or terpolymers |

The amount of vinyl pyridine in the amine-containing polymer can vary widely, but should range from less than 50 weight percent down to at least 0.5 weight percent.

Preferably, the amine content in the basic polymer is expressed in terms of basic nitrogen. In this respect, the nitrogen content in amides and similar nonbasic nitrogen functionality is not part of the interacting species.

A minimum of three basic groups must be present on the average per polymer molecule and the basic nitrogen content generally will range from 4 meq. per 100 grams of polymer up to 500 meq. per 100 g. A range of 8 to 200 meq. per 100 g. is preferred.

The sulfonated polymers of the instant invention may vary in number average molecular weight from 1,000 to 10,000,000, preferably 5,000 to 500,000, most preferably from 10,000 to 200,000. These polymers may be prepared by methods known in the art; for example, see U.S. Pat. No. 3,642,728, hereby incorporated by reference.

It is evident that the sulfonated polymers covered within this invention encompass a broad class of hydrocarbon polymer systems. It is important that these hydrocarbon polymer backbones (in the absence of the sulfonate groups) be soluble in the organic liquid, whose viscosity is to be controlled. To achieve the desired solubility, it is required that the polymer to be employed possess a degree of polarity consistent with that solvent. This solubility relationship can be readily established by anyone skilled in the art simply by appropriate texts (e.g., Polymer Handbook, edited by Brandrup and Immergut, Interscience Publishers, 1967, section IV-341). In the absence of appropriate polymer-solvent compatibility knowledge, this can be determined experimentally by observing whether the selected polymer will be soluble in the solvent at a level of 1 gm polymer per 100 ml solvent. If the polymer is soluble, then this demonstrates that it is an appropriate backbone for modification with sulfonate groups to achieve the objectives of this invention. It is also apparent that polymers which are too polar will not be soluble in the relatively nonpolar organic liquids of this invention. Therefore, only those polymer backbones (i.e., as measured in the absence of ionic groups) having a solubility parameter less than 10.5 are suitable in this invention. This precludes the use of such polymers as polyvinyl alcohol, polyacrylonitrile, etc. Also highly crystalline polymers are to be avoided since they tend not to be soluble in the relatively nonpolar organic liquids employed herein. Therefore, acceptable polymers employed in this invention must possess a level of crystallinity of less than 25%. Thus, these acceptable polymers can be considered substantially noncrystalline.

The preferred ionic EPDM terpolymers for use in the instant invention are prepared by sulfonation of an EPDM-containing ethylidene norbornene units. Other specific examples of preferred ionomeric polymers which are useful in the instant invention include sulfonated polystyrene, sulfonated poly-t-butyl styrene, sulfonated polyethylene, (substantially non-crystalline) and sulfonated polyethylene copolymers, sulfonated polypropylene (substantially noncrystalline), and sulfonated polypropylene copolymers, sulfonated styrene-methyl methacrylate copolymers, (styrene)acrylic acid copolymers, sulfonated polyisobutylene, sulfonated ethylene-propylene terpolymers, sulfonated polyisoprene, sulfonated polyvinyl toluene, sulfonated polyvinyl toluene copolymers and isoprene-styrene sulfonate copolymers formed by a free radical copolymerization process.

The ionomeric polymers of the instant invention may be prepared prior to incorporation into the organic solvent, or by neutralization of the acid form in situ. For example, preferably the acid derivative is neutralized immediately after preparation. For example, if the sulfonation of polystyrene is conducted in solution, then the neutralization of that acid derivative can be conducted immediately following the sulfonation procedure. The neutralized polymer may then be isolated by means well-known to those skilled in the art; i.e., coagulation, steam stripping, or solvent evaporation, because the neutralized polymer has sufficient thermal stability to be dried for employment at a later time in the process of the instant invention. It is well-known that the unneutralized sulfonic acid derivatives do not possess good thermal stability and the above operations avoid that problem.

The t-butyl styrene-vinyl pyridine copolymer of the polymer complex is formed by free radical copolymerization using techniques well-known in the polymer literature. Such polymers can be prepared by a variety of techniques with styrene, t-butyl styrene, alkyl acrylates, alkyl methacrylates, butadiene, isoprene vinyl chloride, acrylonitrile, acrylonitrile/butadiene/styrene monomer mixtures and copolymers, or more complex mixtures. An emulsion polymerization process is generally preferred, but other processes are also acceptable.

The vinyl pyridine content of the preferred copolymer of t-butyl styrene and vinyl pyridine is about 0.5 to about 50 mole percent, more preferably about 0.5 to about 20 mole percent and most preferably about one to about 20 mole percent. The number average molecular weight is about 10,000 to about 10,000,000, preferably about 20,000 to about 5,000,000 and most preferably about 30,000 to about 2,000,000.

The hydrocarbon solution of the polymer complex of the sulfonated polymer and the t-butyl styrene-vinyl pyridine copolymer which exhibits dilatant and anti-misting properties is formed by forming a first solution of the sulfonated polymer in an organic liquid and a second solution of the t-butyl styrene-vinyl pyridine copolymer in the organic liquid, wherein the organic liquid which has a solubility parameter of less than 9.5 and is selected from the group consisting of mineral oil, synthetic oil, alkanes, cycloalkanes and aromatics and mixtures thereof. The concentration of the sulfonated polymer in the first solution is about 0.05 to about 10 grams per 100 ml of organic liquid, more preferably about 0.1 to about 5. The concentration of the t-butyl styrene-vinyl pyridine copolymer in the second solution is about 0.05 to about 10 grams per 100 ml of the organic liquid, more preferably about 0.1 to about 5, and most preferably about 0.1 to about 2. The two solutions of the sulfonated polymer and the t-butyl styrene-vinyl pyridine copolymer are mixed together to form the polymer complex, wherein either the sulfonated polymer or t-butyl styrene-vinyl pyridine copolymer can be substantially in excess of the other. The dissolution process is not limited to the above scheme for example the two polymers can be simultaneously dissolved in the solvent.

The mole ratio between the sulfonate-containing polymer and the amine-containing polymer in solution is about 1:15 to 15:1.

The method of the instant invention includes optionally incorporating a cosolvent in order to weaken or totally disrupt the ionic linkages which weld the intercomplex polymer together thereby reserving the shear thickening phenomonea. For example, a polar cosolvent such as an alcohol or an amine can be added into the mixture of organic liquid and polymer complex, to solubilize the pendant sulfonate groups. The polar cosolvent will have a solubility parameter of at least 10.0, more preferably at least 11.0, and may comprise from 0.1 to 40, preferably 0.5 to 20 weight percent of the total mixture of organic liquid, ionomeric polymer, and polar cosolvent.

There is the additional and important constraint that the polar cosolvent be more polar than the organic liquid. This is required in order that the proper interaction between polar cosolvent and ionic groups be obtained. If we designate the solubility parameter of the organic liquid as $S_L$, and the solubility parameter of the polar cosolvent as $S_p$, then we require that:

$$S_p \geqq S_L + 1.0$$

In other words, the polar cosolvent will be substantially more polar than the organic liquid to be thickened.

Normally, the polar cosolvent will be a liquid at room temperature, however, this is not a requirement. It is required that the polar cosolvent be soluble or miscible with the organic liquid at the levels employed in this invention. Under normal circumstances, this miscibility requirement precludes the use of water as a polar cosolvent. The polar cosolvent must be present in amounts of from 10 to 600 moles per mole of ionic group in order to give the desirable results of the instant invention and preferably from 20 to 400 moles per mole of ionic group.

DESCRIPTION OF THE PREFERRED EMBODIMENTS

The following are preferred embodiments of the instant invention.

EXAMPLE 1

Preparation of t-butyl Styrene Vinyl Pyridine Copolymer

A copolymer of t-butyl styrene and vinyl pyridine was prepared via a free radical emulsion copolymerization process. The preparation was conducted as follows:

In a suitable, stirred reaction vessel under a nitrogen blanket the following ingredients were charged:

120 ml. distilled water
50 g. t-butyl styrene
3.2 g. sodium lauryl sulfate
0.1 g. dodecylthiol
0.2 g. potassium persulfate
4.7 g. 4-vinyl pyridine The polymerization was conducted at 50° C. for 24 hours and the resultant emulsion was fluid and uniform. Three ml. of methanol containing 0.1% of hydroquinone was added as an inhibitor and the reaction mixture was precipitated in a large excess of acetone. The precipitate was filtered, then suspended in methanol and blended in a Waring blender to finally disperse the coagulated polymer. The suspension was filtered and dryed in a vacuum oven at 60° C. for 24 hours.

The resulting product represented 80% conversion of the reactive monomers and contained 1.68% nitrogen corresponding to 12.5 mole % 4-vinyl pyridine incorporation.

EXAMPLE 2

Preparation of Sulfonated EPDM

The preparation of sulfonated EPDM has been well-described in the patent and published literature (for example, see U.S. Pat. No. 4,184,988 or ACS Monograph edited by A. Eisenberg, 1980, p. 4). A zinc sulfonated EPDM was prepared via those procedures containing 10 meq. of zinc sulfonate, designated MS-14. The resulting polymer was available as a free-flowing crumb and employed in that form as a blending component in the following examples.

EXAMPLE 3

The following solutions of polymers in jet fuel A were prepared:

Solution A 0.5 weight % of MS-14, a zinc-Sulfo-EPDM in jet fuel A. MS-14 is a zinc salt of sulfonated EPDM terpolymer. The sulfonation level was 10 milliequivalents per 100 g backbone. The backbone was a 90,000 weight average molecular weight EPDM with a content of 55 weight % ethylene, 45 weight % propylene, and 5 weight % ethylidene-norbornene (ENB).

Solution B 0.5 weight % of tertiary-butyl-styrene/vinylpyridine copolymer (TSB-VPyr) designated 10563-78 in jet fuel A. The TBS-VPyr copolymer contained about 10 mole % VPyr and had an intrinsic viscosity in xylene at 25° C. of 4.3 (in the order of 1 million MW).

Both solutions were readily prepared by mild stirring using a magnetic stirrer.

Solutions A and B were further combined to yield instantaneous interpolymer complexes in solutions at a total polymer concentration of 0.5 weight %. This was done at various ratios and the viscosity-shear rate relation of these solutions was measured by a Haake Rotovisco CV-100 viscometer at 25° C. The low shear viscosity of these solutions at 0.6 $sec^{-1}$ was:

| Solution | Parts A/Parts B | Moles $SO_3-/N^+$ | Viscosity, cp |
|---|---|---|---|
| B | 0/100 | 0 | 3.6 |
| C | 25/75 | 0.03 | 4.9 |
| D | 50/50 | 0.10 | 15.0 |
| E | 65/35 | 0.18 | 33.0 |
| F | 75/25 | 0.30 | 1420 |
| G | 85/15 | 0.57 | 3750 |
| H | 90/10 | 0.90 | 317 |
| I | 95/5 | 1.90 | 7.5 |
| A | 100/0 | ∞ | 2.5 |

The sharp increase in viscosity for the mixed solutions over the individual ones (A and B) suggests a creation of a large polymeric network in the jet fuel solution.

EXAMPLE 4

All the solutions described in Example 3 were tested in terms of their viscosity shear rate dependence using a Haake CV-100 viscometer at 25° C.

It was found that solutions F, G, and H of Example 3 exhibited a shear thickening behavior.

As an example for solution H at 25° C.:

| Shear Rate (l/sec) | Viscosity (cP) |
|---|---|
| 0.3 | 100 |
| 0.6 | 317 |
| 0.75 | 348 |
| 3.0 | 107 |
| 30.0 | 24 |

EXAMPLE 5

Mixtures of solutions A and B of Example 1 were studied in a tubeless siphon. The height at which the unsupported column of liquid breaks is an indication of solution extensional viscosity.

The greatest column height at break was obtained for about 50/50 mixtures of solutions A and B (about a 10:1 ratio of $N^+$ to $SO_3-$).

For a 50/50 mixture at a 0.5 weight % total polymer concentration in jet fuel A and with further dilution in jet fuel A, the following were measured column heights at break:

| Total Concentration (wt. %) | Column Height (mm) |
|---|---|
| 0.5 | 7–12 |
| 0.45 | 4–8 |
| 0.40 | 6 |
| 0.35 | 5–5.5 |
| 0.30 | 3–6 |

Examples 4 and 5 show shear thickening and existence of tubeless siphon behavior for jet fuel solutions of the instant invention. These solutions are expected to exhibit antimisting behavior according to the criterions of Peng and Landel (J. Appl. Phys., 52, 5988, of 1981 and in "Rheology" Vol. 2 edited by G. Astarita, p. 385, Plenum Press, 1980).

EXAMPLE 6

A small amount of methanol, a polar liquid, was added to solutions G and H of Example 3. Upon addition of the alcohol, the viscosity dropped sharply. When 0.5 parts of methanol were added to 99.5 parts of the solutions, the following viscosities were measured at 25° C.:

| Solution | Viscosity With 0.5% MeOH (cP) | Original Viscosity (cP) |
|---|---|---|
| G | 4.0 | Up to 3750* |
| H | 3.5 | Up to 348* |

*Shear thickening

Example 6 shows that the antimisting behavior expected of the solutions in this instant invention can be reversed by the addition of polar cosolvents and that methanol is effective as such an additive at concentrations below 1%.

Since many modifications and variations of this invention may be made without departing from the spirit or scope of the invention thereof, it is not intended to limit the spirit or scope thereof to the specific examples thereof.

What is claimed is:

1. An antimisting hydrocarbon solution comprising a jet fuel and a polymer complex, wherein the concentration of said polymer complex in said solution is about 0.01 to about 2 grams per 100 ml of said solution and said polymer complex comprises the interaction product of a metal neutralized sulfonated polymer and an amine containing polymer which has a vinyl pyridine comonomer incorporated therein, said metal neutralized sulfonated polymer having a polymer backbone which has a solubility parameter of less than about 10.5 and a crystallinity of less than about 25%, said metal neutralized sulfonated polymer containing about 4 to about 200 meq. of metal neutralized sulfonate groups per 100 gram of polymer, said metal neutralized sulfonate groups being neutralized with a metal ion selected from the groups consisting of zinc, copper, iron, nickel, cobalt, antimony and lead, the nitrogen content of the amine containing polymer is about 4 meq. to about 500 meq. per 100 gram of polymer, said amine containing polymer being soluble in said jet fuel.

2. A process for reducing antimisting according to claim 1, further including the addition of about 1000 ppm to about 10 weight percent of a polar cosolvent to the solution, said polar cosolvent having a solubility parameter of at least 10.0.

3. The solution of claim 1, wherein the neutralized sulfonated polymer contains zinc as the counterions.

4. The solution of claim 1, wherein said sulfonated polymer is derived from an EPDM terpolymer.

5. The solution of claim 1, wherein the amine containing polymer is a copolymer of t-butyl styrene and vinyl pyridine.

6. The solution of claim 1, wherein said sulfonated polymer is in excess of said amine containing polymer.

7. The solution of claim 1, wherein said amine containing polymer is in excess of said sulfonated polymer.

8. The solution of claim 2, wherein said sulfonated polymer is selected from the group consisting of sulfonated polyethylene, sulfonated polypropylene, sulfonated ethylene-polypropylene copolymers and terpolymers, wherein the third monomer is a nonconjugated diene hydrocarbon having from 5 to 15 carbon atoms and sulfonated polystyrene.

9. The solution of claim 2, wherein said polar cosolvent is selected from the group consisting of alcohols and amines.

10. The solution of claim 9, wherein said polar cosolvent has a boiling point of at least 50° C.

* * * * *